United States Patent [19]

Idota et al.

[11] Patent Number: 4,514,488

[45] Date of Patent: Apr. 30, 1985

[54] SILVER SALT DIFFUSION TRANSFER PROCESS USING HYDROXYLAMINE AND PYRAZOLIDINONE DEVELOPING AGENTS

[75] Inventors: Yoshio Idota; Noriyuki Inoue, both of Minami-ashigara, Japan

[73] Assignee: Fuji Photo Film Co., Ltd., Kanagawa, Japan

[21] Appl. No.: 594,235

[22] Filed: Mar. 28, 1984

[30] Foreign Application Priority Data

Apr. 4, 1983 [JP] Japan ..... 58-58989

[51] Int. Cl.[3] ..... G03C 5/54; G03C 5/30; G03C 5/38; G03C 1/42

[52] U.S. Cl. ..... 430/234; 430/249; 430/250; 430/480; 430/483

[58] Field of Search ..... 430/249, 250, 234, 480, 430/483

[56] References Cited

U.S. PATENT DOCUMENTS

| | | | |
|---|---|---|---|
| 2,857,276 | 10/1958 | Land | 430/250 |
| 3,433,634 | 3/1969 | De Heas | 430/249 |
| 3,687,662 | 8/1972 | Willems et al. | 430/250 |

*Primary Examiner*—Richard L. Schilling

[57] ABSTRACT

In a process for forming an image by diffusion transfer, this process for forming an image comprises performing the diffusion transfer by using a hydroxylamine represented by the formula:

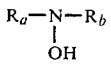

as a developing agent, and using a cyclic imide as a silver halide solvent in the presence of a 1-aryl-3-pyrazolidinone compound represented by the formula:

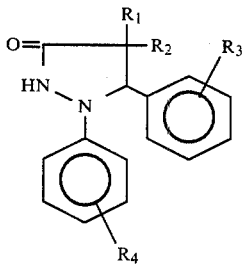

12 Claims, No Drawings

SILVER SALT DIFFUSION TRANSFER PROCESS USING HYDROXYLAMINE AND PYRAZOLIDINONE DEVELOPING AGENTS

BACKGROUND OF THE INVENTION

1. Field of the Invention

This invention relates to a process of forming an image by silver salt diffusion transfer, and a film unit used therefor.

The process of forming an image by diffusion transfer using a silver salt such as silver halide is well-known. The procedure of this process is as follows. An exposed photosensitive silver halide emulsion layer is first processed with an aqueous alkaline solution containing a developing agent and a silver halide solvent. The exposed silver halide grains are reduced to silver by the developing agent, while the unexposed silver halide grains are converted to a transferable silver complex salt by the silver halide solvent. This silver complex salt is diffused and transferred by inbibition to a layer containing silver-precipitating nuclei (an image-receiving layer) laid over the emulsion layer, where the silver complex salt is reduced by the developing agent with the aid of the silver-precipitating nuclei, to provide a silver image.

When practicing this process, use is usually made of a film unit which comprises a combination of (i) a photosensitive element containing a layer of photosensitive silver halide emulsion on a support, (ii) an image-receiving element which includes an image-receiving layer containing silver-precipitating nuclei on a support, and (iii) a processing element which consists of breakable containers which hold a viscous aqueous alkaline solution containing a developing agent, a silver halide solvent, and a thickener. The emulsion layer of the photosensitive element (i) is first exposed, then the photosensitive element is placed over the image-receiving element in such a way that the emulsion layer is against the image-receiving layer of the image-receiving element (ii), and these layers are passed between a pair of rollers so that the processing element (iii) is broken and the viscous aqueous alkaline solution it contains can spread, and are then allowed to stand for a predetermined time. The image-receiving element (ii) is then peeled off the photosensitive element (i) to provide a print comprising the image-receiving layer in which the desired image has been formed.

2. Description of the Prior Art

In order to improve the image formed by such an image formation process using diffusion transfer, a variety of processes have already been proposed. In particular, the invention described in Japanese Patent Publication No. 13580/1974 discloses a process comprising the use of a combination of a 1-aryl-3-pyrazolidinone compound with a hydroxylamine derivative to provide a development process which is rapid, and can thus reduce the processing time.

However, it has been found that the 1-aryl-3-pyrazolidinone compound used in the invention of Japanese Patent Publication No. 13580/1974 has a problem concerning long-term storage characteristics, although it is effective for high-speed development.

As a result of extensive studies aimed at improving the long-term storage characteristics of the 1-aryl-3-pyrazolidinone compound, without affecting the rapidity of development, the inventors of this invention have found that this drawback in the prior art can be solved by using a specific selected 1-aryl-3-pyrazolidinone compound together with a specific hydroxylamine.

SUMMARY OF THE INVENTION

This invention relates to a novel process for forming an image by silver salt diffusion transfer.

It is an object of this invention to provide a photosensitive element (i), an image-receiving element (ii), and a processing element (iii), which are highly sensitive but are stable during long-term storage.

It is another object of this invention to provide a film unit comprising these elements (i), (ii) and (iii) and which is useful for practicing this image formation process, and which has a sensitivity and excellent long-term storage characteristics.

One aspect of this invention relates to an improvement in the process of forming an image by diffusion transfer which comprises developing an exposed photosensitizing silver halide emulsion layer in the presence of a developing agent, a silver halide solvent and an alkali, to convert at least part of the unexposed silver halide in said emulsion layer to a transferable silver complex salt, and transferring at least part of said silver complex salt to an image-receiving layer containing silver-precipitating nuclei to form an image in said image-receiving layer. The improved process of forming an image comprises: performing that diffusion transfer of the exposed photosensitive material using a hydroxylamine represented by the following general formula (I) as the developing agent, and using a cyclic imide compound as the silver halide solvent in the presence of a 1-aryl-3-pyrazolidinone compound represented by the following general formula (II): general formula (I):

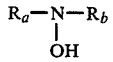

(I)

where $R_a$ is an alkyl, alkoxyalkyl or alkoxyalkoxyalkyl group; and $R_b$ is hydrogen, or an alkyl, alkoxyalkyl, alkoxyalkoxyalkyl, or alkenyl group; these alkyl and alkoxy groups preferably having 1 to 3 carbon atoms, and the alkenyl groups preferably having 2 to 3 carbon atoms; general formula (II):

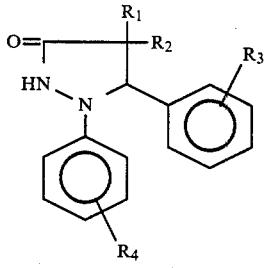

(II)

where $R_1$ and $R_2$ may be the same or different, and are hydrogen, or an alkyl group of 1 to 3 carbon atoms; and $R_3$ and $R_4$ may be the same or different and hydrogen or an alkyl group of 1 to 2 carbon atoms.

Another aspect of this invention relates to a film unit used in the practice of this process, in which the film unit for this silver salt diffusion transfer process comprises a photosensitive element (i) provided with layer of photosensitive silver halide emulsion on a support, (ii) an image-receiving element provided with an image-receiving layer containing silver-precipitating nuclei on a support, and (iii) a processing element provided with breakable containers which hold a viscous aqueous alkaline solution containing a developing agent, a silver halide solvent, and thickener; wherein a hydroxylamine of general formula (I) is used as the developing agent, a cyclic imide compound is used as the silver halide solvent, and a 1-aryl-3-pyrazolidinone compound represented by general formula (II) is included in at least one of said three elements.

According to this invention, it is possible to obtain a highly-sensitive, film unit for image formation which is stable with time, and with this process it is possible to obtain a high-quality positive image.

Further, this photosensitive silver halide emulsion layer also makes it possible to apply a technique according to the previous invention (Japanese Patent Application No. 14038/1983), that is, the technique of using flat plate-shaped silver halide grains of a diameter/thickness ratio of at least 5 as at least 40% by weight of the total quantity of silver halide in the emulsion.

The use of the flat plate-shaped silver halide grains makes it possible to obtain an image formation process and a film unit therefor which can provide these effects achieved by this invention, and also makes it possible to obtain prints within a short processing time. Accordingly, such an embodiment is also within the scope of this invention.

DESCRIPTION OF THE PREFERRED EMBODIMENTS

A more detailed description of this invention will now be made.

The processing element (iii) used in the image formation process of this invention, or in the film unit therefor, is a solution comprising, according to one embodiment, an alkali, a hydroxylamine developer (formula (I)), a cyclic imide compound, a silver halide solvent, and a 1-aryl-3-pyrazolidinone compound (formula (II)).

It is also possible in this invention to add part or all of the developer and/or the silver halide solvent to the photosensitive element (i) and/or the image-receiving element (ii).

The 1-aryl-3-pyrazolidinone compounds used preferably in this invention include, in particular, 1,5-diphenyl-3-pyrazolidinone, 1-(p-tolyl-5-phenyl-3-pyrazolidinone, 1-phenyl-5-(p-tolyl)-3-pyrazolidinone or mixtures thereof. The quantity used varies somewhat, depending on whether the compound is added to the photosensitive element (i), or is contained in the solution of the element (iii), and is $10^{-8}$ to $10^{-4}$ mole/m$^2$ (calculated as a coating weight), preferably $10^{-7}$ to $10^{-5}$ mole/m$^2$, for the former case; and $10^{-4}$ to $5\times10^{-2}$ mole/l, preferably $10^{-3}$ to $10^{-2}$ mole/l, for the latter case.

In this invention, it is also possible to add the 1-aryl-3-pyrazolidinone compound to the image-receiving element (ii) as well as to the photosensitive element (i) and the processing element (iii), this can also provide the various effects of the invention.

Examples of the hydroxylamine developers of general formula (I) which can be used as the developing agent of this invention include: N,N-diethylhydroxylamine, N,N-bismethoxyethylhydroxylamine, N,N-bisethoxyethylhydroxylamine, N,N-bismethoxyethoxyethylhydroxylamine, N-ethyl-N-ethoxyethylhydroxylamine, N-allyl-N-ethoxyethylhydroxylamine, and mixtures thereof.

The quantity of developer used is 0.05 to 1 mole, preferably 0.08 to 0.4 mole, and more preferably 0.1 to 0.3 mole, per liter of the solution in the processing element (iii).

Examples of the alkalis which can be used in this invention include alkali metal hydroxides, e.g., sodium hydroxide and potassium hydroxide. The quantity thereof used is 0.5 to 4 mole/l, preferably 1 to 3 moles/l.

Examples of the cyclic imide compounds used in this invention as the silver halide solvent include those described in U.S. Pat. Nos. 2,857,274, 2,857,275, and 2,857,276. In particular, the use of uracil, urazol, or 5-methyluracil is preferable. The quantity of this compound used is 0.1 to 1 mole, preferably 0.3 to 0.8 mole, and more preferably 0.3 to 0.6 mole, per liter of the solution in the processing element (iii).

According to one embodiment of this invention, it is possible to distribute the solution in the processing element (iii) as a thin layer between the photosensitive element (i) and the image-receiving element (ii) laid one on the other. In this case, it is preferable that the processing element (iii) contains an agent which forms a polymer film, a concentrator or a thickener. For this purpose, hydroxyethylcellulose or sodium carboxymethylcellulose are particularly useful. The quantity thereof added is such that the concentration of the agent in the solution in the processing element (iii) is sufficient to give a suitable viscosity according to the well-known principle of diffusion transfer photography. The processing element (iii) may also contain other aids that are well-known for the silver transfer process, for example, antifoggants, toning agents, stabilizers, etc. It is particularly useful for prolonging the shelf life of the processing solution to add an oxyethylamino compound, such as triethanolamine (see U.S. Pat. No. 3,619,185).

In this invention, the processing element (iii) is contained preferably in breakable containers. These breakable containers and the materials therefor may be anything that is well-known, as described in detail in U.S. Pat. Nos. 3,056,491, 3,056,492, 3,173,580, 3,750,907, 3,833,381, 4,303,750, 4,303,751, etc.

The image-receiving element (ii) in this invention comprises a support which includes an image-receiving layer containing a silver-precipitating agent (e.g., a layer of regenerated cellulose). This support can be any well-known one, for example, baryta paper, cellulose triacetate, polyester, etc., can be used therefor.

The image-receiving element (iii) will now be described in more detail. The support is first coated with a coating solution containing a dispersed silver-precipitating agent. The coating solution could be, for example, a cellulose ester, in particular cellulose diacetate. If necessary, the support can be treated to form a substratum. The thus-obtained cellulose layer is then hydrolyzed by treatment with an alkali to convert at least the surface in the depthwise direction of the cellulose ester into regenerated cellulose. This is used as the image-receiving layer. In a particularly useful embodiment, the unhydrolyzed portion of the cellulose ester layer containing cellulose diacetate may include one or more mercapto compounds which are suitable for improving the tone, stability, and other photographic properties of the silver-transfer image. These mercapto compounds diffuse from their initial position during the inhibition. An image-receiving element of this type is described in U.S. Pat. No. 3,607,269.

Examples of the modified silver-precipitating agents used in this invention include heavy metals, such as iron, lead, zinc, nickel, cadmium, tin, chromium, copper, and cobalt, and in particular noble metals such as gold, silver, platinum, palladium, etc. Examples of other useful silver-precipitating agents are heavy metal sulfides and selenides, in particular sulfides of mercury, copper, aluminum, zinc, cadmium, cobalt, nickel, silver, lead, antimony, bismuth, cerium, and magnesium, and selenides of lead, zinc, antimony, and nickel. (For the formation of a silver-precipitating agent, see, for example, U.S. Pat. No. 2,774,667.)

It is preferable in one embodiment of this invention to provide an acidic polymer layer which has the function of neutralizing the processing solution, between the image-receiving layer and its support. Preferable acidic polymers which can be used include copolymers of unsaturated carboxylic acids such as acrylic acid, methacrylic acid, itaconic acid, and crotonic acid, and acidic cellulose derivatives. More specifically, butyl acrylate/acrylic acid copolymers, cellulose acetate hydrogen phthalate, ethyl methacrylate/methacrylic acid copolymers, and methyl methacrylate/methacrylic acid copolymers can be used. In addition to these, polymers containing sulfonic acid groups such as polystyrenesulfonic acid and acetalization products of polyvinyl alcohol and benzaldehydesulfonic acid can be used.

In order to prevent the processing solution adhering to the surface of the image-receiving layer when it is peeled off after the processing solution is spread over it, it is preferable to apply a release layer to the surface of the image-receiving layer. Examples of these release layers include gum arabic, hydroxyethylcellulose, methylcellulose, polyvinyl alcohol, sodium alginate, and also the release layers described in U.S. Pat. Nos. 3,772,024 and 3,820,999 and British Patent No. 1,360,653.

In one special embodiment of this invention, it is possible to incorporate the image-receiving layer within the photosensitive element (i), as described below. For example, an image-receiving layer containing silver-precipitating nuclei, a light-reflecting layer containing a white pigment such as titanium dioxide, a light-shielding layer containing a light-absorbing substance such as carbon black, and a photosensitive silver halide emulsion layer are applied in that order to the surface of a polyethylene terephthalate sheet.

In this embodiment, it is possible to observe the image formed in the image-receiving layer through the polyethylene sheet because, after the diffusion transfer treatment, the rear layer can be shielded by the light-reflecting layer even if the photosensitive silver halide emulsion layer is not peeled off.

The photosensitive element (i) used in this invention can also be obtained by coating a support with photographic emulsion, as described below in detail.

The photographic emulsion in this invention may contain any of the following as the silver halide: silver iodobromide, silver iodochlorobromide, silver chlorobromide, and silver chloride. A preferable silver halide is silver iodobromide or silver iodochlorobromide containing less than 10 mol % silver iodide. A particularly preferable silver halide is silverbromoiodide containing 3 to 10 mol % silver iodide.

Although the average grain size (defined as the grain diameter for spherical or nearly spherical grains, and the edge length for cubic grains, and specified by an average based on projected areas) is not particularly limited, it is preferably less than 3 microns, more preferably less than 1.5 microns, and even more preferably 0.8 to 1.2 microns.

The distribution of grain sizes is not particularly limited.

The silver halide grains in the photographic emulsion may be of any of a variety of shapes such as those having isometric crystal forms such as cubes and octahedra, those having heteromorphic crystal forms such as spheres and plates, as well as compounds of these crystal forms. They may be used alone or joined together.

The silver halide grains each have an interior and a surface layer which may be composed of different phases or the same phase. The silver halide grains may be those in which a latent image is formed chiefly on their surfaces, or may be those in which the latent image is formed chiefly within the grains. However, grains in which the latent image is formed on their surfaces are preferable.

With regard to the silver halide grains, it is possible, as mentioned earlier, to achieve a reduction of the processing time by using flat plate-shaped silver halide grains of a diameter/thickness ratio of at least 5 in an quantity of at least 40% by weight, based on the total quantity of silver halide grains in the emulsion. In this embodiment, the thickness of the emulsion layer is 0.5 to 8.0 microns, preferably 0.6 to 6.0 microns, and the quantity of silver halide grains coated is 0.1 to 3 $g/m^2$, preferably 0.2 to 1.5 $g/m^2$. The process of preparing the flat plate-shaped silver halide grains of this type is described in detail in Japanese Patent Laid-Open No. 127,921/1983.

The photographic emulsion of this invention can be prepared by using processes described in Chiemie et Physique Photographique, by P. Glafkides (published by Paul Montel Co., Ltd., 1967), Photographic Emulsion Chemistry, by G. E. Duffin (published by The Focal Press, 1966), Making and Coating Photographic Emulsion, by V. L. Zelikman, et al, (published by The Focal Press, 1964), etc. Namely, any acidic, neutral or ammonia process may be used, and when reacting a soluble silver salt with a soluble halogen salt, it is possible to use any of one-side mixing process, simultaneous mixing process, or a combination thereof. It is also possible to use a process in which grains are formed in the presence of an excess of silver ions (the so-called back-mixing process). A process in which the pAg in the liquid phase in which the silver halide is formed is kept constant, that is, the so-called controlled double-jet process can also be used as one form of a simultaneous mixing process.

According to this method, it is possible to provide a silver halide emulsion which has a regular crystal form and nearly uniform grain sizes. It is also possible to use a mixture of at least two silver halide emulsions which are formed separately.

During the formation of the silver halide grains or of their physical ageing, it is possible to use cadmium salts, zinc salts, lead salts, thallium salts, iridium salts or iridium complex salts, rhodium salts or rhodium complex salts, iron salts or iron complex salts, etc.

After the formation of a precipitate or its physical ageing, soluble salts are usually removed. As means for this, the well-known Nudel washing process carried out after the gelation of gelatin may be used. A flocculation method utilizing an inorganic salt which has polyvalent anions (e.g., sodium sulfate), an anionic surfactant, an anionic polymer (such as polystyrenesulfonic acid), a gelatin derivative (such as an aliphatic-acylated gelatin or an aromatic-acylated gelatin) or the like can be used.

It is also possible to omit the step of removing the soluble salts.

Although the silver halide emulsion may be one that is not subjected to chemical sensitization, i.e., a so-called primitive emulsion, it is usually a chemically sensitized emulsion. When performing the chemical sensitization, it is possible to use the processes described in the articles books by Glafkides, Duffin and Zelikman, or that in Grundlagen der Photographishen Prozesse mit Silberhalogenid-emulsionen, by Frieser (Akademische Verlaggesellschaft, 1968).

The silver halide emulsion used in this invention may contain an antifoggant or a stabilizer. Compounds with such properties that can be used therefor are described in Product Licensing Index Vol. 92, p 107, "Antifoggants and stabilizers".

The silver halide emulsion may contain a developing agent. Any of the developing agents described in Product Licensing Index, Vol. 92 p 107–108, "Developing agents" may be used therefor.

The silver halide can be dispersed in a colloid which can be hardened by an organic or inorganic hardener. Any of the hardeners described in Product Licensing Index, Vol. 92, p 108, "Hardeners" can be used therefor.

The silver halide emulsion may contain a coating aid. Any of the coating aids described in Product Licensing Index, Vol. 92 p 108, "Coating aids" can be used therefor.

The silver halide emulsion may also contain an antistatic agent, a plasticizer, a brightening agent, an aerial fog inhibitor, etc.

The silver halide emulsion used in this invention contains a vehicle which is described in Product Licensing Index, Vol. 92, p 108, "Vehicles" (December 1971).

The silver halide emulsion together with, if necessary, other photographic layers is applied to a support. Any of the methods of application, described in Product Licensing Index, Vol. 92, p 109, "Coating procedures" can be used therefor, and the any of the supports described in Product Licensing Index Vol. 92, p 108, "Supports" can be used.

In order to obtain an increased sensitivity, increased contrast, and accelerated developing, it is possible to add a substance such as a polyalkylene oxide or its ether, ester or amine derivatives, a thioether compound, a thiomorpholine, a quaternary ammonium salt compound, a urethane derivative, a urea derivative, an imidazole derivative, a 3-pyrazolidone or the like to the photographic emulsion of this invention. For example, the additives described in U.S. Pat. Nos. 2,400,532, 2,423,549, 2,716,062, 3,617,280, 3,772,021, 3,808,003, etc., can be used.

The photosensitive material made according to this invention may contain a water-soluble dye or another hydrophilic colloid layer acting as a filter dye or for the purpose of preventing irradiation or the like. Examples of such dyes include oxonol dyes, hemioxonol dyes, styryl dyes, merocyanine dyes, cyanine dyes, and azo dyes. Of these dyes merocyanine dyes such as oxonol dyes and hemioxonol dyes are useful. The dyes may be mordanted into a specific layer by a cationic polymer, such as dialkylaminoalkyl acrylate.

When the photosensitive material made according to this invention contains a dye, an ultraviolet ray absorber or the like in an aqueous silver colloid layer, it may be mordanted with a cationic polymer or the like. It is possible to use, for example, the polymers described in British Patent No. 685,475, U.S. Pat. Nos. 2,675,316, 2,839,401, 2,882,156, 3,048,487, 3,184,309, and 3,445,231, West German Offen-Legungs Schrift (OLS) No. 1,914,362, Japanese Patent Laid-Open Nos. 47624/1975 and 71,332/1975, etc.

The exposure for forming the photographic image may be done in the usual manner. Namely, it is possible to use any of known light sources such as natural light (sunlight), tungsten lamps, fluorescent lamps, mercury vapor lamps, xenon arc lamps, carbon arc lamps, xenon lamps, the flying spot of a cathode-ray tube, etc. It is possible to use any of the exposure time of 1/1,000 to 1 sec which are usually used for cameras, as well as exposure times of less than 1/1,000 sec such as exposure times of $1/10^4$ to $1/10^6$ sec using a xenon flash lamp or cathode-ray tube, and also exposure times of longer than 1 sec. If desired, it is also possible to control the spectral energy distribution of the light used for the exposure with a color filter. It is also possible to use a laser beam for the exposure, or perform the exposure with light emitted from a fluorescent substance excited by electron beams, X-rays, $\gamma$-rays, etc. Arrangements and bonding methods used in combining the photosensitive element, image-receiving element and processing element to form a film unit, are described in, for example, HANDBOOK OF PHOTOGRAPHY AND REPROGRAPHY, by Neblettés, 7th ed., pages 282–285, and specific preferred embodiments thereof are described in detail in U.S. Pat. No. 3,350,991. Therefore, they can be used as references.

According to this invention, it is thus possible to improve long-term storage characteristics without detriment to the speed of development, and it is also possible to provide an extremely highly sensitive positive image by selecting a specific 1-aryl-3-pyrazolidinone compound and using this compound in combination with a specific hydroxylamine.

It is also possible to reduced the development time further, as well as obtain the above effects by using flat plate-shaped silver halide grains in the silver halide emulsion of the photosensitive element.

This invention will now be described in more detail with reference to examples, but this invention should not be limited to these examples.

EXAMPLE 1

Photosensitive Sheet

Silver halide grains were made by a single jet process, then aged physically, desalted and further aged chemically to obtain a silver iodobromide emulsion (containing 5.5 mol % iodine). The silver halide grains in this emulsion had an average diameter of 0.9 micron. 1 kg of this emulsion contained 0.65 mole of silver halide. This emulsion was placed in 1 kg portions in pots, and were then placed in a constant temperature bath (50° C.) to dissolve them.

Each of these portions was mixed under agitation with an orthochromatic sensitizing dye, 3-{5-chloro-2-ethyl-3-ethyl-2-benzothiazolinylidene) propenyl)-3-benzoxazolio}-propane-sulfonate), a panchromatic sensitizing dye, 4-{2-[3-ethylbenzothiazolin-(2-ylidene)-2-methyl-1-propenyl]-3-benzothiazolio}propane-sulfonate, 10 ml of a 1% by weight aqueous solution of 4-hydroxy-6-methyl-1,3,3a,7-tetrazoindene, 10 ml of a 1% by weight aqueous solution of 2-hydroxy-4,6dichlorotriazine sodium salt, 10 ml of a 1% by weight aqueous solution of sodium dodecylbenzenesulfonate; and a quantity of the solution in a water/methanol mixture of the compound of this invention (a: 1,5-diphenyl-3-pyrazolidinone, b: 1-(p-tolyl)-5-phenyl-3-pyrazolidinone, and c: 1-phenyl-5-(p-tolyl)-3-pyrazolidinone), as shown in Table 1. Each of these emulsions was applied over an undercoated polyethylene terephthalate film support containing titanium dioxide to provide a dry film thickness of 3 microns, and was then dried to provide samples. At the same time, an aqueous gelatin solution was applied to provide a dry film thickness of 1 micron. The quantity of silver thus coated was 0.5 g/m$^2$.

Image-Receiving Sheet

Polyethylene laminated paper sheets provided with a 6 μm-thick cellulose triacetate layer were immersed for one minute in an alkaline hydrolysis solution containing silver-precipitating nuclei to form standard image-receiving sheets for diffusion transfer.

The alkaline hydrolysis solution was prepared as follows. 0.1 g nickel nitrate was dissolved in 2 ml water, this solution was added to 100 ml glycerin, and the resultant solution was then mixed under violent agitation with 1 g sodium sulfide dissolved in 2 ml water to obtain a dispersion of silver-precipitating nuclei of nickel sulfide. 20 ml of this dispersion was added to 1,000 ml of a water/methyl alcohol (1/1) solution in which 80 g sodium hydroxide was dissolved to prepare an alkaline hydrolysis solution containing silver-precipitating nuclei.

Each of these photosensitive sheets, before and after being subjected to forced degradation conditions (60° C. for 3 days), were exposed to form sensitometry images. Diffusion transfer development was performed by spreading the following processing solution to a thickness of 0.1 mm between the photosensitive sheet and the image-receiving sheet.

| Processing solution | |
|---|---|
| Potassium hydroxide (40% aqueous solution) | 323 ml |
| Titanium dioxide | 3 g |
| Hydroxyethylcellulose | 79 g |
| Zinc oxide | 9.75 g |
| N,N—Bismethoxyethylhydroxylamine | 75 g |
| Triethanolamine 45% aqueous solution | 17.14 g |
| Tetrahydrophyrimidinedione | 0.4 g |
| 2,4-Dimercaptopyrimidine | 0.35 g |
| 6-n-Propylthiouracil | 0.35 g |
| Uracil | 90 g |

-continued

| Processing solution | |
|---|---|
| Water | 1193 ml |

The optical densities of the obtained transferred silver images were measured, and their sensitivities were defined as the reciprocals of exposures which gave an optical density of 0.7. Table 1 shows these sensitivities expressed in terms of relative values with respect to a value of 100 which was the sensitivity of a sample which had no additives (photosensitive sheet No. 1) and which was not forcibly degraded.

TABLE 1

| Sample photo-sensitive sheet | Developing agent | Quantity added | Before forced degradation | | After forced degradation | | |
|---|---|---|---|---|---|---|---|
| | | | Sensi-tivity | Density of silver transferred | Sensi-tivity | Density of silver transferred | |
| 1 | — | — | 100 | 1.70 | 110 | 1.65 | (Comparative example) |
| 2 | 1-phenyl-3-pyrazolidinone | $1.0 \times 10^{-6}$ mole | 150 | 1.70 | 150 | 1.20 | (Comparative example) |
| 3 | Compound (a) | $1.0 \times 10^{-6}$ mole | 152 | 1.70 | 150 | 1.68 | (This invention) |
| 4 | Compound (b) | $1.0 \times 10^{-6}$ mole | 140 | 1.70 | 145 | 1.65 | (This invention) |
| 5 | Compound (c) | $1.0 \times 10^{-6}$ mole | 145 | 1.70 | 145 | 1.65 | (This invention) |

In Comparative example 2, the density of the transferred silver was reduced by the forced degradation, but in Samples 3 to 5 to which the compounds of this invention were added, this reduction in the density of the transferred silver was extremely small. The sensitivities of Samples 3 to 5 were higher than that of Sample 1.

EXAMPLE 2

A photosensitive material (which did not contain any compound of this invention) and the image-receiving sheet of Example 1 were used.

The processing solution was prepared by adding $4 \times 10^{-3}$ mole/l of the compounds of this invention (a, b, or c) to the processing solution of Example 1.

TABLE 2

| Processing solution | Compound | Before forced degradation | | After forced degradation | |
|---|---|---|---|---|---|
| | | Sensi-tivity | Den-sity | Sensi-tivity | Density |
| 1 | — | 100 | 1.70 | 100 | 1.70 |
| 2 | 1-phenyl-3-pyra-zolidinone | 150 | 1.70 | 130 | 1.65 |
| 3 | Compound (a) | 160 | 1.70 | 155 | 1.70 |
| 4 | Compound (b) | 155 | 1.70 | 150 | 1.70 |
| 5 | Compound (c) | 155 | 1.70 | 140 | 1.65 |

The results given in Table 2, like those in Example 1, show the effectiveness of this invention.

What is claimed is:

1. In a process of forming an image by diffusion transfer comprising developing an exposed photosensitizing silver halide emulsion layer in the presence of a developing agent, a silver halide solvent and an alkali, to convert at least part of the unexposed silver halide in said emulsion layer to a transferable silver complex salt, and transferring at least part of said silver complex salt to an image-receiving layer containing silver-precipitating nuclei to form an image in said image-receiving layer; the process of forming an image comprising performing said diffusion transfer of said exposed photosensitive material using a hydroxylamine represented by the following general formula (I) as said developing agent, and using a cyclic imide compound as said silver halide solvent in the presence of a 1-aryl-3-pyrazolidinone compound represented by the following general formula (II):

general formula (I):

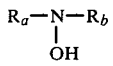

(I)

where $R_a$ is an alkyl, alkoxyalkyl or alkoxyalkoxyalkyl group; and $R_b$ is hydrogen, or an alkyl, alkoxyalkyl, alkoxyalkoxyalkyl, or alkenyl group;

general formula (II):

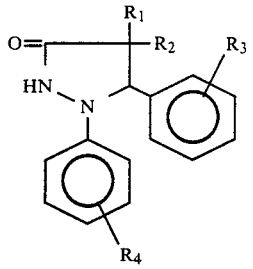

where $R_1$ and $R_2$ may be the same or different, and are hydrogen, or an alkyl group of 1 to 3 carbon atoms; and $R_3$ and $R_4$ may be the same or different and are hydrogen or an alkyl group of 1 to 2 carbon atoms.

2. The process of forming an image as set forth in claim 1, wherein N,N-diethylhydroxylamine is used as said hydroxylamine.

3. The process of forming an image as set forth in claim 1, wherein N,N-bismethoxyethylhydroxylamine is used as said hydroxylamine.

4. The process of forming an image as set forth in claim 1, wherein N,N'-bisethoxyethylhydroxyamine is used as said hydroxylamine.

5. The process of forming an image as set forth in claim 1, wherein uracil is used as said cyclic imide compound.

6. The process of forming an image as set forth in claim 1, wherein 1,5-diphenyl-3-pyrazolidinone is used as said 1-aryl-3-pyrazolidinone compound.

7. In a film unit for a silver salt diffusion transfer process comprising a photosensitive element provided with a photosensitive silver halide emulsion layer on a support, an image-receiving element provided with a layer containing silver-precipitating nuclei on a support, and a processing element provided with breakable containers which hold a viscous aqueous alkali solution containing a silver halide solvent, wherein one of said photosensitive element, said image-receiving element and said processing element contains a developing agent, the film unit for a silver salt diffusion transfer process prepared by using a hydroxylamine of the following formula (I) as said developing agent, using a cyclic imide compound as said silver halide solvent, and adding a 1-aryl-3-pyrazolidinone compound represented by the following general formula (II) to at least one of said three elements:

general formula (I):

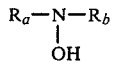

where $R_a$ is an alkyl, alkoxyalkyl or alkoxyalkoxyalkyl group; $R_b$ is hydrogen, or an alkyl, alkoxyalkyl, alkoxyalkoxyalkyl, or alkenyl group;

general formula (II):

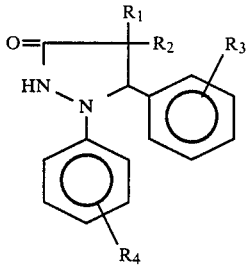

where $R_1$ and $R_2$ are the same or different, and are hydrogen or an alkyl of 1 to 3 carbon atoms, and $R_3$ and $R_4$ are the same or different, and are hydrogen or an alkyl group of 1 to 2 carbon atoms.

8. The film unit for the silver salt diffusion transfer process as set forth in claim 7, wherein N,N-diethylhydroxylamine is used as said hydroxylamine.

9. The film unit for the silver salt diffusion transfer process as set forth in claim 7, wherein N,N-bismethoxyethylhydroxylamine is used as said hydroxylamine.

10. The film unit for the silver salt diffusion transfer process as set forth in claim 7, wherein N,N-bisethoxyethylhydroxyamine is used as said hydroxylamine.

11. The film unit for the silver salt diffusion transfer process as set forth in claim 7, wherein uracil is used as said cyclic imide compound.

12. The film unit for the silver salt diffusion transfer process as set forth in claim 7, where 1,5-diphenyl-3-pyrazolidinone is used as said 1-aryl-3-pyrazolidinone compound.

* * * * *